US008096292B1

(12) United States Patent
Demko et al.

(10) Patent No.: US 8,096,292 B1
(45) Date of Patent: Jan. 17, 2012

(54) MULTIPLE DART BLOW GUN PROJECTILE HOLDER

(75) Inventors: Andrew Demko, Wampum, PA (US); Michael T. Wallace, New Castle, PA (US)

(73) Assignee: Cold Steel, Ventura, CA (US)

( * ) Notice: Subject to any disclaimer, the term of this patent is extended or adjusted under 35 U.S.C. 154(b) by 133 days.

(21) Appl. No.: 12/661,776

(22) Filed: Mar. 24, 2010

(51) Int. Cl.
*F41B 1/00* (2006.01)

(52) U.S. Cl. ..... 124/62

(58) Field of Classification Search ..... 124/62; D22/102

See application file for complete search history.

(56) References Cited

U.S. PATENT DOCUMENTS

| | | | | | |
|---|---|---|---|---|---|
| 2,679,838 | A | * | 6/1954 | Thompson | 124/62 |
| 3,685,828 | A | * | 8/1972 | Getgey et al. | 273/356 |
| 3,802,345 | A | | 4/1974 | La Costa | |
| 3,811,622 | A | * | 5/1974 | Blatt | 239/526 |
| 4,010,902 | A | * | 3/1977 | Speyer | 239/428.5 |
| 4,419,978 | A | | 12/1983 | Loftus | |
| D282,765 | S | * | 2/1986 | Shipman | D22/102 |
| 4,854,294 | A | * | 8/1989 | Lala | 124/62 |
| 5,544,642 | A | | 8/1996 | Guthrie | |
| 5,902,955 | A | | 5/1999 | Rossmann | |
| D591,827 | S | * | 5/2009 | Huang | D23/223 |
| 2006/0042615 | A1 | * | 3/2006 | Gregory | 124/62 |
| 2008/0216806 | A1 | * | 9/2008 | Tseng | 124/62 |

FOREIGN PATENT DOCUMENTS

| | | | | |
|---|---|---|---|---|
| JP | 11201692 | A | * | 7/1999 |
| JP | 2002357399 | A | * | 12/2002 |
| JP | 2009139013 | A | * | 6/2009 |

* cited by examiner

*Primary Examiner* — Troy Chambers
(74) *Attorney, Agent, or Firm* — Harpman & Harpman

(57) ABSTRACT

A multi-dart blow gun projectile holder that provides for insertion and launching of multiple blow gun darts from a blow gun. The projectile holder has dual hollow open engagement cones secured together in oppositely disposed relation to one another. Multiple wire darts are selectively positioned by their base in one of said cones while the remaining cone imparts an air seal within the blow gun under user applied air pressure propelling and holding the position darts as they travel out of the blow gun during use.

7 Claims, 3 Drawing Sheets

MULTIPLE DART BLOW GUN PROJECTILE HOLDER

BACKGROUND OF THE INVENTION

1. Technical Field

This invention relates to blow guns that are used to project darts at a target or live game, specifically blow gun dart holders and sabots for loading and launching multiple darts at the same time from a blow gun.

2. Description of Prior Art

Prior art devices have been directed to providing multiple projectile holders such as projectile sabots more commonly found in gun or cannon art, see for example U.S. Pat. Nos. 3,802,345, 4,419,978, 5,544,642, 5,902,955 and EP0087502.

In U.S. Pat. No. 3,802,345 a multiple projectile sabot for use in a rifled gun barrel is disclosed in which a number of spin stabilized projectiles are held.

U.S. Pat. No. 4,419,978 illustrates a blow gun and dart holder for multiple wire based darts to be held in position outside the gun for rapid deployment and use.

U.S. Pat. No. 5,544,642 discloses multiple projectile blow gun magazine assembly in which multiple projectile holding tubes are arranged so that they can be sequentially engaged by the user in a Gatling gun like manner.

U.S. Pat. No. 5,902,955 claims a sabot for a sub-caliber projectile by which a casing is used about a smaller diameter projectile allowing it to be used in a larger interior diameter environment.

Finally, European Patent EP0087502 illustrates a projectile system for a barrel weapon with a number of sub-caliber projectiles to be fired simultaneously by use of a sabot. The projectiles are longitudinally aligned within the holder for deployment and open firing.

SUMMARY OF THE INVENTION

A blow gun dart holder for simultaneously launching of multiple darts from within a single blow gun. The dart holder combines a dart retention and stabilizing dart insertion end with a corresponding identical reverse pneumatic projectile end which allows the quick placement of multiple wired darts in a self-aligning engagement pattern and launching therefrom.

DETAILED DESCRIPTION OF THE INVENTION

Figure 1:
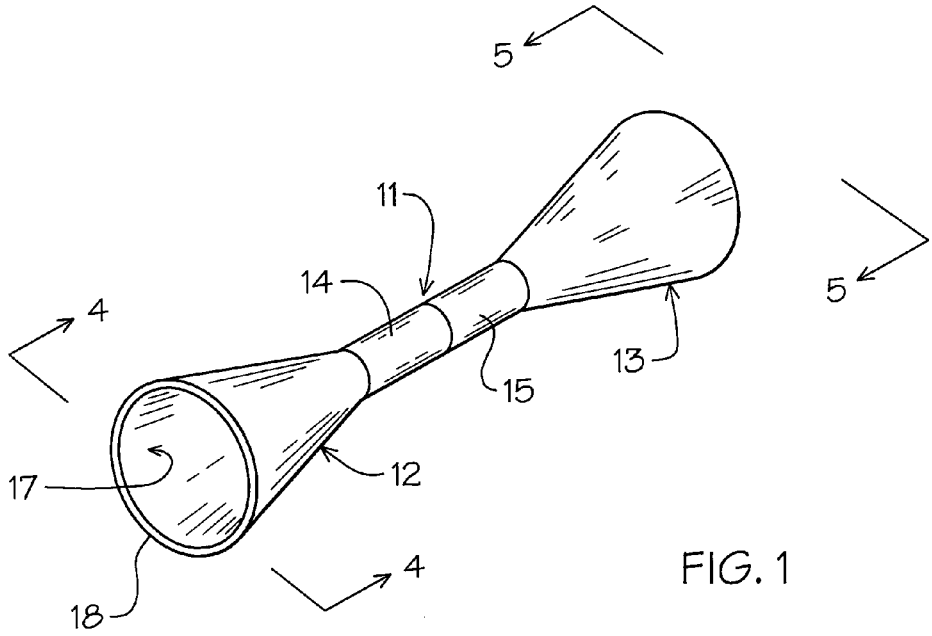
FIG. 1 is a perspective view of the multi-dart projectile holder.
Figure 2:
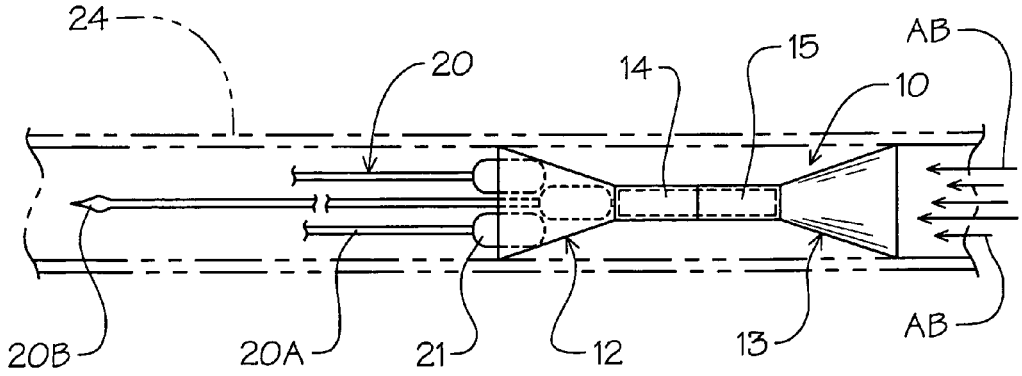
FIG. 2 is a side elevational view thereof positioned within a blow gun shown in broken lines with darts loaded within.
Figure 3:
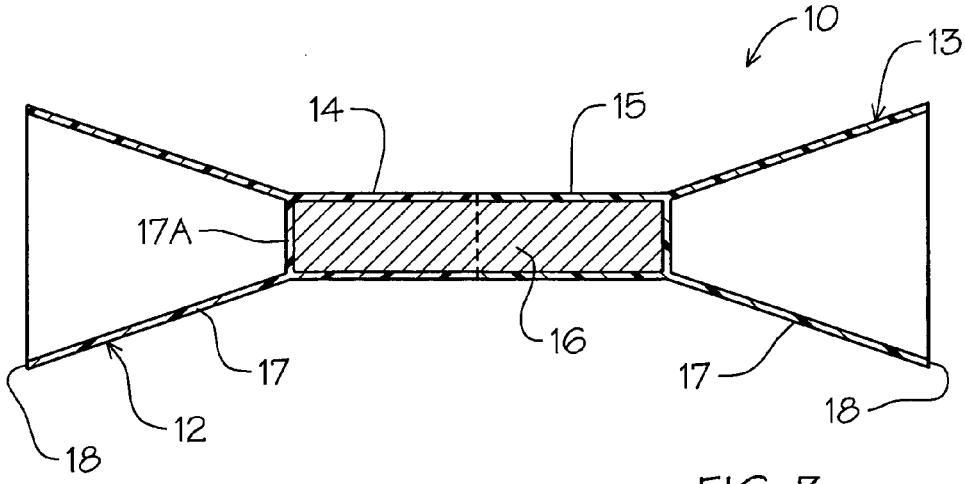
FIG. 3 is an enlarged cross-sectional view of the multi-dart projectile holder.
Figure 6:
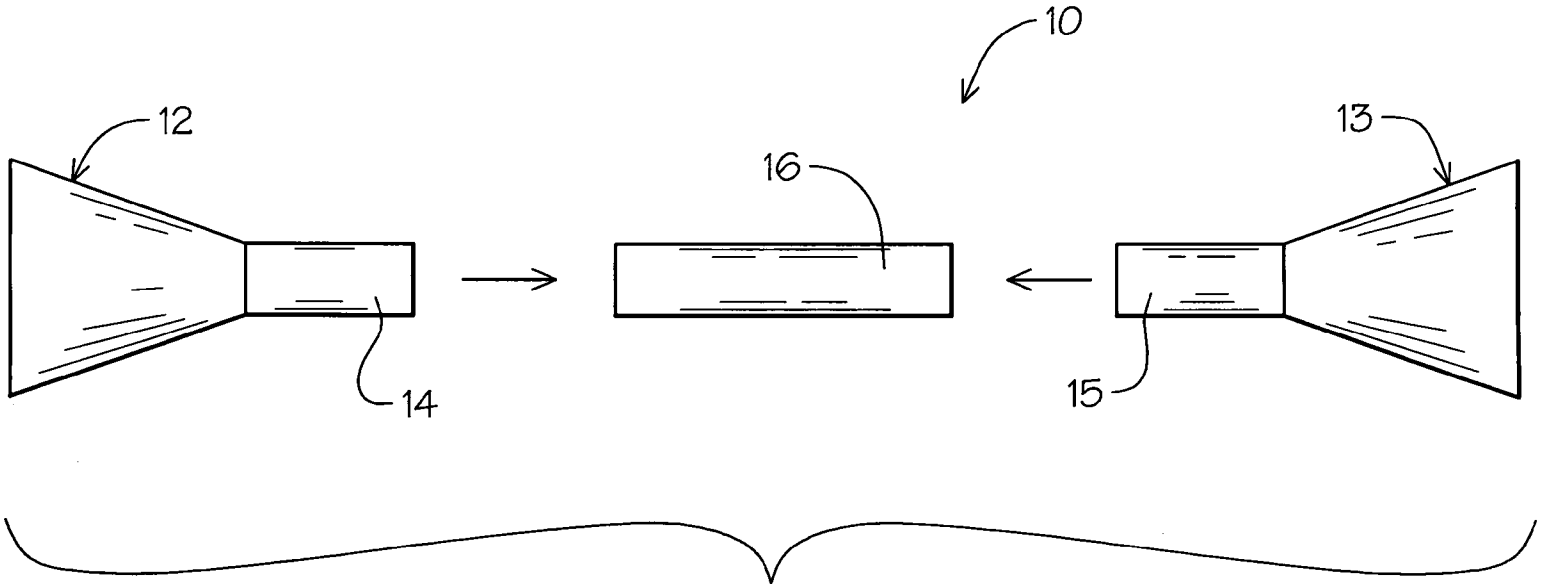
FIG. 6 is an exploded side assembly view of the multi-dart projectile holder.

Referring to FIGS. 1, 2 and 3 of the drawings, a dart projectile holder 10 of the invention can be seen having a main central body member 11 with a pair of identical oppositely disposed hollow cone configured end portions 12 and 13 extending therefrom. The main central body member 11 is made up of two respective open ended cylinders 14 and 15 joined to one another in abutting longitudinal aligned relationship by a solid metal pin 16 frictionally fit therewithin. Each of the open end cylinders 14 and 15 are identical having a respective closed end 14A and 15A from which extends the integral conical end portions 12 and 13 respectively. It will be seen that by interconnecting identical open ended cylinder bodies 14 and 15 with integral hollow conical cone end portions 12 and 13, the unique dual ended projectile holder 10 of the invention is formed as best seen in assembly in FIG. 6 of the drawings.

Referring now to FIGS. 2-5 of the drawings, the blow gun dart projector holder 10 of the invention can be seen wherein the respective hollow conical cone dart end portions have a continuous tapered sidewall 17 extending from a closed end bulk head 17A. The sidewall 17 has an annular perimeter end edge 18 so as to define a multiple wire blow gun dart receptacle area 19 therewithin.

Figure 4:
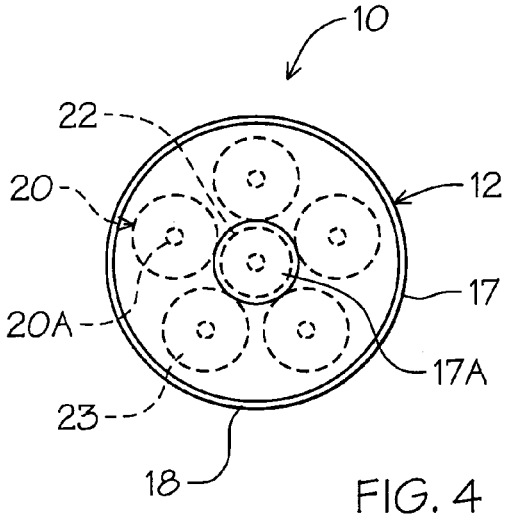
FIG. 4 is an enlarged end plan view on lines 4-4 of FIG. 1 with the darts positioned therein illustrated in broken lines.
Figure 5:
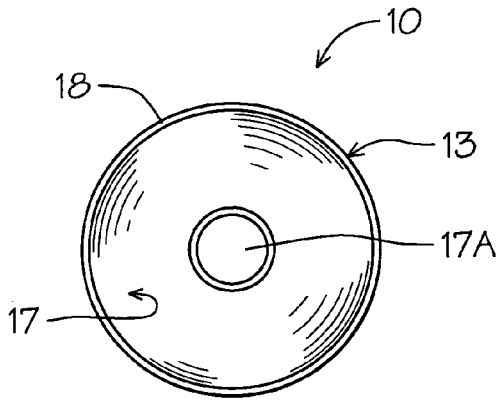
FIG. 5 is an enlarged end plan view on lines 5-5 of FIG. 1.

Referring to FIGS. 2 and 4 of the drawings, the receiving orientation of blow gun wire type darts 20, known within the art, can be seen positioned within the conical end portion 12 in this example chosen for illustration in which each dart 20 has a wire shaft 20A, end tip 20B and an oppositely disposed enlarged solid base end fitting 21 press fit thereon. Such wire blow gun darts 20 are typical within the art and provide a cost efficient dart configuration that can be easily and inexpensively mass produced.

The enlarged solid base fitting 21 of the dart 20 defines an engagement and retainment surface configuration dimension that when grouped together as seen in FIGS. 2 and 4 of the drawings in their respective conical end portions 12 adjustably position themselves in a predetermined size base pattern P determined by the number of such darts 20 so inserted. In this example, a maximum dart number so achieved maintains the base fittings 21 within the parameters of the conical cone portion 12 by a center dart 22 positioned against the closed end bulk head with remaining darts 23 positioned annularly thereabout registerably engaging on the center dart 22 base fitting 21 and engaging the interior surface of the continuous sidewall 16 at a predetermined point based on the angular inclination of the wall and the annular orientation retainment of the multiple dart base fittings 21 so engaged inserted within the cone end portion 12 engaging simultaneously onto the center defined dart 22, as noted.

This dart orientation achieved by the relative size of the defined dart base and the engagement within the cone end portion assures that once loaded within a blow gun 24 shown in broken lines for illustration purposes in FIG. 2 of the drawings, that when an air blast AB indicated by airflow arrows 25 that the associated user induced air pressure will propel the multiple dart projectile holder 10 of the invention down and out of the blow gun 24 with the multiple darts 20 so aligned therewithin until dart flight access when the multiple dart projection holder 10 will fall away from the now airborne darts projectory towards a target (not shown) in a projectile pattern.

It is important to note that by utilization of a single molded element 26 having the conical cone end portion and integrally extending open ended cylinder as described can be interconnected in effacing pairs by friction fit over the single pin 16 will form the dart projectile holder 10 of the invention with its inclusive oppositely disposed hollow cone portions 12 and 13 and interconnecting main central cylindrical body member 11 which can be interchangeably positioned within the blow gun.

It will thus be seen that a new and novel integrated multiple dart projectile holder 10 has been illustrated and described and it will be apparent to those skilled in the art that various changes and modifications may be made therein without departing from the spirit of the invention.

Therefore I claim:

1. A blow gun dart projectile retainer comprising, an elongated central body member, first and second hollow cone portions extending from said central body member, said first and second cone portions being identical, said first and second cone portions being in reversed longitudinally aligned spaced relation to one another defining a forward facing projectile receiving cone and a rearward facing projectile cone for projecting same through the blow gun under the influence of user excelled propellant air there against.

2. The blow gun dart projectile retainer set forth in claim 1 wherein said elongated central body member comprises, a pair of identical cylindrical members interengaged over a main connection pin.

3. The blow gun dart projectile retainer set forth in claim 2 wherein said identical cylindrical members have said first and second cone portions extending integrally and respectively therefrom.

4. The blow gun dart projectile retainer set forth in claim 1 wherein said central body member and said first and second cones are of molded synthetic resin material.

5. The blow gun dart projectile retainer set forth in claim 1 wherein said forward facing projectile receiving cone and said rearward facing propellant cone have a closed end bulk head, a contoured continuous tapered sidewall extending therefrom with an end wall perimeter edge.

6. A blow gun dart multiple projectile retaining device comprising, a pair of identical open cone portions each having a cylinder extending therefrom, an interconnecting pin registerable within said open ends of said respective cylinders adjoining said open cone portions in oppositely disposed aligned orientation to one another, said open cone portions having a tapered conical sidewall extending from a closed bulk head between said sidewall and said respective cylinders extending therefrom.

7. The blow gun dart multiple projectile retaining device set forth in claim 6 wherein said pair of identical open cone portions with said cylinders extending integrally therefrom are made of molded synthetic resin material.

* * * * *